US006150611A

United States Patent [19]

Imai

[11] Patent Number: 6,150,611

[45] Date of Patent: Nov. 21, 2000

[54] SHIELDING CABLE-TERMINATING STRUCTURE AND SHIELDED CABLE-TERMINATION METHOD

[75] Inventor: Koji Imai, Kanagawa, Japan

[73] Assignee: The Whitaker Corporation, Wilmington, Del.

[21] Appl. No.: 09/376,956

[22] Filed: Aug. 18, 1999

[30] Foreign Application Priority Data

Aug. 19, 1998 [JP] Japan ..... 10-232577

[51] Int. Cl.[7] ..... H01R 9/00

[52] U.S. Cl. ..... 174/78

[58] Field of Search ..... 174/75 C, 78, 174/74 R, 84 C, 88 C; 439/98, 99, 100, 610

[56] References Cited

U.S. PATENT DOCUMENTS 5,525,078 6/1996 Springer ..... 439/610

6,010,369 1/2000 Itabashi et al. ..... 439/660

OTHER PUBLICATIONS

JP07176363, Application No. 06239065, Filed 19941004, Published 19950714.

JP09204801, Application No. 08012427, Filed 19960129, Published 19970805.

*Primary Examiner*—Dean A. Reichard

*Assistant Examiner*—Chau N. Nguyen

[57] ABSTRACT

The present invention provides a sealed cable-terminating structure in which a braided-shielding member is fastened to supporting members with high strength, and in which an optimum shielding effect can be ensured, and a simple termination method for realizing such a terminating structure. An end portion of a shielding member (50) on a clamped side has a folded-back section (55*a*), which is formed by being turned inward. A portion of the folded-back section (55*a*) is fastened by clamping to socket (20) by a clamping member (31), and it is extended by a prescribed length in a direction away from the fastened portion.

3 Claims, 4 Drawing Sheets

50
51
125
100
111
120
110

50
51
100

50
125
120
110
100
55a 50
120
110
100
51
55a

51
X1
50
55a
100

50
51
225
220
210
211
200

50
51
200

50
51
220
200
210

50
225
220
210
200
55b
51

50
X2
51
55b
200
210
220

SHIELDING CABLE-TERMINATING STRUCTURE AND SHIELDED CABLE-TERMINATION METHOD

FIELD OF THE INVENTION

The present invention relates to a shielded cable-terminating structure used in an assembly formed by assembling a shielded cable and an electrical connector, and a termination method used to realize the terminating structure.

BACKGROUND OF THE INVENTION

In assemblies formed by assembling a shielded cable and an electrical connector, constructions are known in which a shielding member of the cable is terminated by means of a metal member. One example of such a construction is disclosed in Japanese Patent No. 7-176353. In this example, the shielding member is fastened to an outer covering of the shielded cable by means of a metal-clamping member that is folded back to the outside. The metal-clamping member is constructed so that it is fastened to another supporting member.

On the other hand, in Japanese Patent No. 9-204801, an assembly in which a shielded cable is terminated to an electrical connector used for an automobile discharge lamp is disclosed. In this assembly, a braided-shielding member is terminated at a position on a metal cover. In this type of application, the shielded cable is formed with a simple construction that does not include an outer covering; accordingly, a construction of the type disclosed in Japanese Patent No. 7-176353 mentioned above cannot be applied, and a construction that terminates only the braided-shielding member is required.

In particular, the problems involved in the latter application are that the retention strength of the shielding member is weak in portions of the terminating structure of a braided-shielding member, and that there is a danger that the shielding effect will be unsatisfactory in the vicinity of such portions. Specifically, in the case of a braided-shielding member, the braids tend to unravel in the vicinity of the cut-end portion of the shielding member, so that in cases where such a shielding member is simply fastened by clamping, there is a danger that this portion will gradually come undone and come loose from the clamp-fastened portion, or that unintentional holes will be formed in the vicinity of the end portion, so that the shielding effect becomes unsatisfactory.

Accordingly, an important object of the present invention is to provide a sealed cable-terminating structure in which a braided-shielding member is fastened with high strength to a supporting member, an optimum shielding effect can be ensured, and a simple termination method for such a terminating structure is realized.

SUMMARY OF THE INVENTION

The present invention is directed to a shielded cable-terminating structure that includes a braided-shielding member, at least a portion of which is a conductive material, the shielding member has folded-back sections of prescribed dimensions in which the shielding member is folded back toward an inside at ends thereof so that a double layer is formed, and portions of the folded-back sections are fastened to supporting members by clamping members.

The supporting members are insulating bodies, and they are a section of a connector housing or a waterproof cap.

The clamping members are a conductive material; the clamping members may be integrally joined to a shielding shell surrounding a connector housing.

Furthermore, the present invention provides a shielded cable-termination method wherein end portions of a braided-shielding member for a shielded cable with at least a portion of which being a conductive material are treated so as to be folded back toward an inside therealong, and a process in which the end portions of the shielding member that are folded back are positioned on supporting members and fastened thereon by clamping from an outside by clamping members.

Preferably, following the process in which the shielding member is treated, there is an additional process in which at least one insulated wire is passed through an inside of the shielding member.

Preferably, the process in which the shielding member is treated is accomplished by pushing a tool, which has an annular protruding member into the vicinity of the end portions, and bending the shielding member along the annular protruding member.

Preferably, the tool has an outer member which includes the annular protruding member, and an inner member which is positioned so that the inner member can slide along an inside of the outer member, and the method includes a process in which the outer member and inner member are caused to move relative to each other either before or after the tool is pushed into the vicinity of the end portions, so that a bent shape in the vicinity of the end portions can be realized as a double layer.

BRIEF DESCRIPTION OF THE DRAWINGS

Embodiments of the present invention will now be described by way of example with reference to the accompanying drawings in which:

FIG. 1 illustrates a cable connector assembly which contains a shielded cable-terminating structure of the present invention.

FIG. 2 shows part enlarged longitudinal cross-sectional views which illustrate portions of the cable connector assembly shown in FIG. 1.

DETAILED DESCRIPTION OF THE PRESENT INVENTION

Figure 1A:
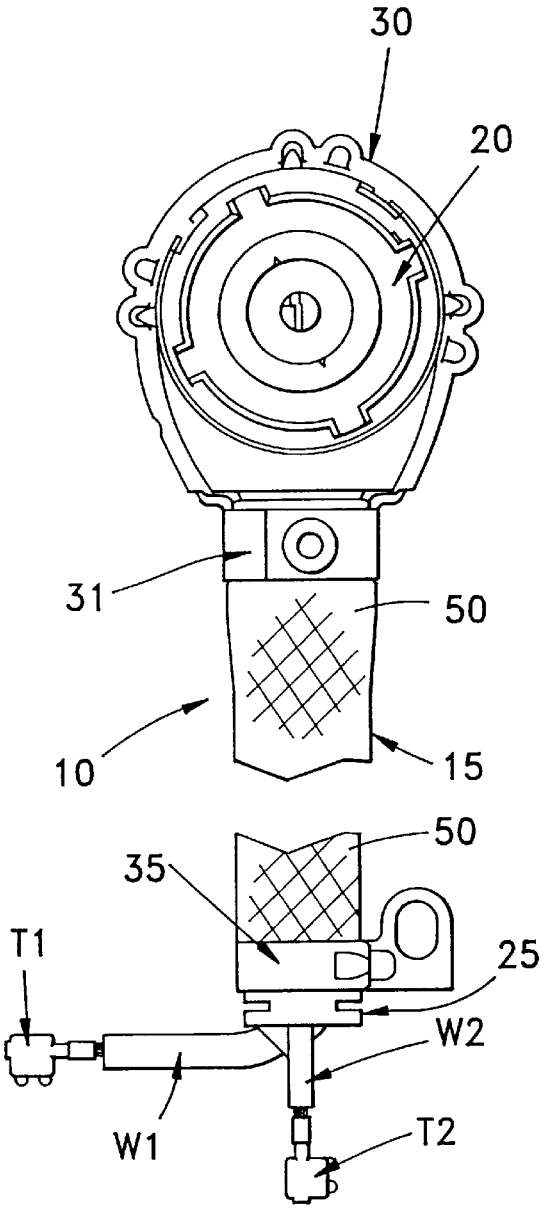
FIG. 1*a* is a front view.
Figure 1B:
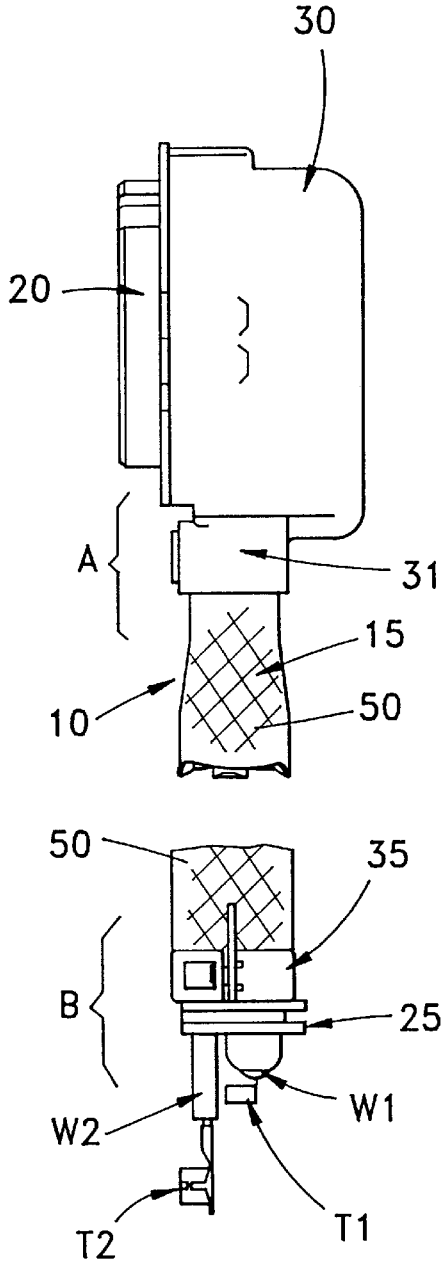
FIG. 1*b* is a side view.

Like the assembly disclosed in Japanese Patent No. 9-204801 referred to above, cable connector assembly 10 is a socket assembly for a discharge lamp used in an automobile, and it includes a shielded cable 15 and a socket 20 positioned at one end of the shielded cable 15. The socket 20 is enveloped by a metal-shielding shell 30, which has an integral clamping member 31 that clamps shielding member 50 of the shielded cable 15 thereto. The shielding member 50 is a braided tubular member, at least one portion of which comprises a conductive fiber, rope-form material or yarn-form material. A waterproof rubber cap 25 is disposed on the other end of the shielded cable 15, and electrical wires W1, W2 extend from cap 25. Electrical terminals T1, T2 are respectively electrically connected to the wires W1, W2. As shown in FIGS. 1*a* and 1*b*, the other end of the shielding member 50 is fastened to the cap 25 by a clamping member 35.

Figure 2A:
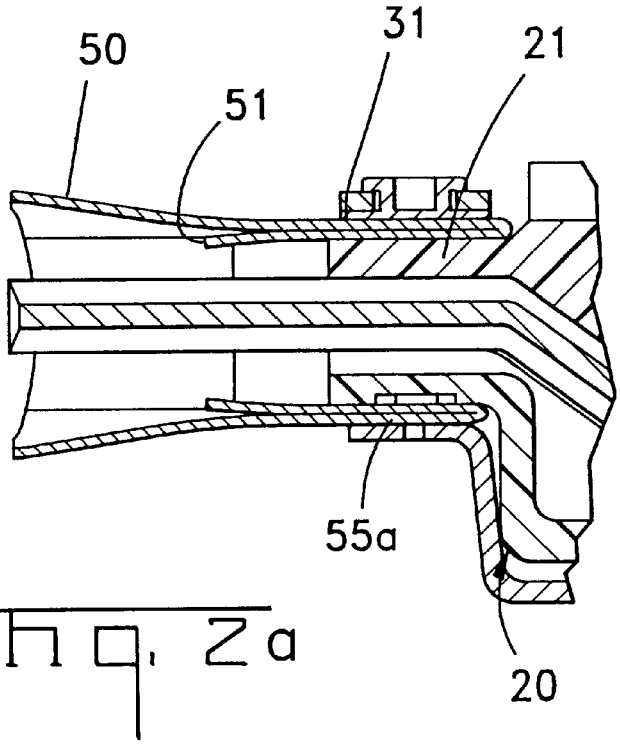
FIG. 2*a* shows portion A in FIG. 1*b*.
Figure 2B:
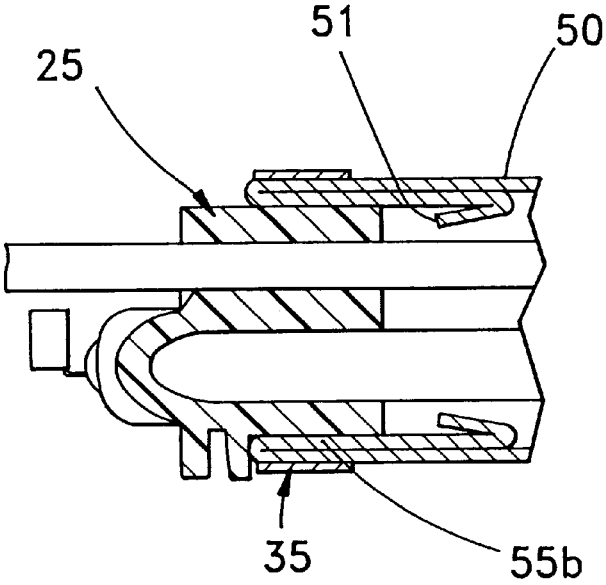
FIG. 2*b* shows portion B in FIG. 1*b*.

FIG. 2 shows in particular the detailed structure by which the shielding member 50 is fastened in the terminating structure of the shielded cable 15. As was shown schematically in FIG. 1, the shielding member 50 is fastened at one end to a fastening section 21 of the socket 20 by means of a clamping member 31, and it is fastened at the other end to the rubber cap 25 by means of a clamping member 35. It should especially be noted that in the vicinity of the portions that are fastened by clamping or crimping, there are folded-back sections 55*a*, 55*b* in which the shielding member 50 is folded back toward the inside so that a double-layer structure is formed, and the folded-back sections 55*a*, 55*b* are disposed so that they are separated from the portions fastened by clamping and extend a prescribed distance. As a result, deleterious effects caused by the unraveling of the cut ends 51 of the braided-shielding member 50, which have conventionally been a problem, can be prevented. First of all, in the clamped portions, there is no danger that the clamping strength will drop as a result of gaps being formed between the braids of the shielding member 50. In other words, the clamping member 31 or clamping member 35 can support the shielding member 50 over a relatively broad area; accordingly, the clamping strength is increased. Secondly, the generation of gaps between the braids in the vicinity of the clamped portions is eliminated as a result of the shielding member 50 being folded back by a prescribed length (for example, approximately 2 to 6 cm in the present embodiment), so that a highly-reliable shielding effect can be realized. In conventional structures, the particular problem of an unsatisfactory shielding effect due to the generation of gaps between the braids in the vicinity of the boundary area where slipping from the fastening section 21 or cap 25 occurs has been encountered. Thirdly, since the cut ends of the shielding member 50 are positioned so that the cut ends are hidden inside the shielding member 50, there is no anger that the shielding member 50 will become unraveled as a result of interference with outside parts during handling or manufacture of the cable connector assembly 10. Fourth, the insertion of the wires W1, W2 into the shielding member 50 is facilitated. The method used to construct the terminating structure will be described later in regard to this point.

When the cable connector assembly 10 constructed according to the present invention is assembled as shown in FIGS. 1 and 2, the wires W1, W2 and the shielding member 50 making up the shielded cable 15 are separately prepared. In the first process of the termination of the shielded cable 15, the wires W1, W2 are first connected to electrical contacts (not shown) inside the socket 20, and they are positioned so that the wires extend from the socket 20. In parallel with the first process, a process in which the shielding member 50 is folded back toward the inside may be performed as a second process. This second process is performed using a prescribed tool.

Figures 3A, 3B, 3C, 3D, 3E:
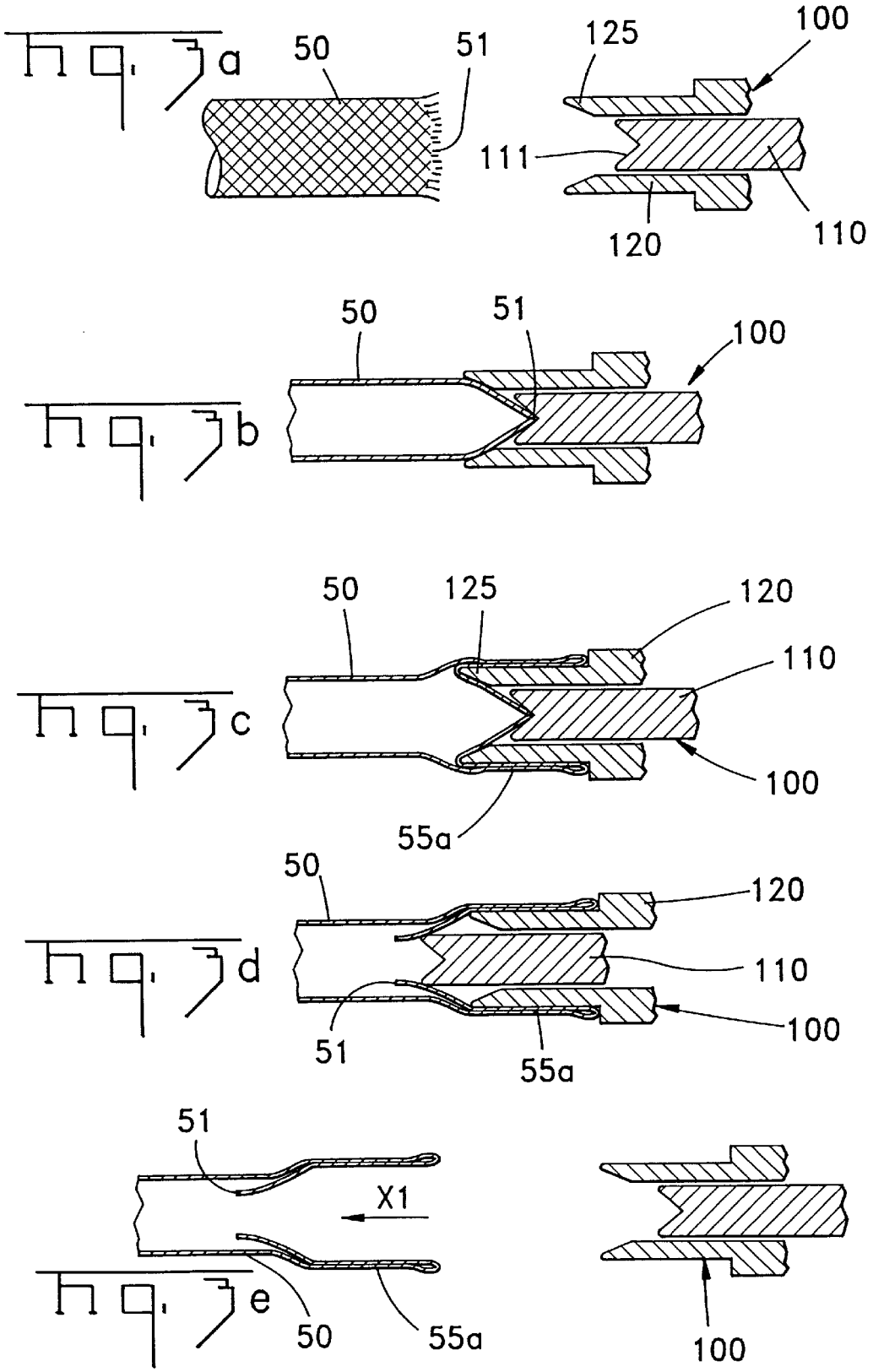
FIGS. 3*a*–3*e* show schematic diagrams illustrating the process in which the shielding member is folded back by using a tool.

FIGS. 3*a*–3*e* show schematic diagrams illustrating the process in which the shielding member is folded back by using a tool 100. The tool 100 shown in FIG. 3 includes an inner member 110 and outer member 120 which can move relative to each other. In particular, it should be noted that the outer member 120 includes an annular protruding section 125. First, the tool 100 as shown in FIG. 3*a* is positioned so that it faces the cut end 51 of the shielding member 50. Next, the tool 100 is moved to a position so that a V-shaped recess 111 in inner member 110 accommodates the cut end 51 as shown in FIG. 3*b*. Furthermore, the tool 100 is pressed against the shielding member 50; in this case, the shielding member 50 is bent so that it turns inward on an outside surface of the annular protruding section 125. As a result, a folded-back section 55*a* is formed (see FIG. 3*c*). Afterward, the inner member 110 is pushed further into the interior of the shielding member 50 in relative terms, so that the folded-back section 55*a* in the vicinity of the cut end 51 is inserted in an inward direction and extends along an inside surface of the shielding member (see FIG. 3*d*). Finally, the tool 100 is removed from the shielding member 50; as a result, the folded-back structure is completed as a double-layer section as shown in FIG. 3*e*.

Figures 4A, 4B, 4C, 4D, 4E:
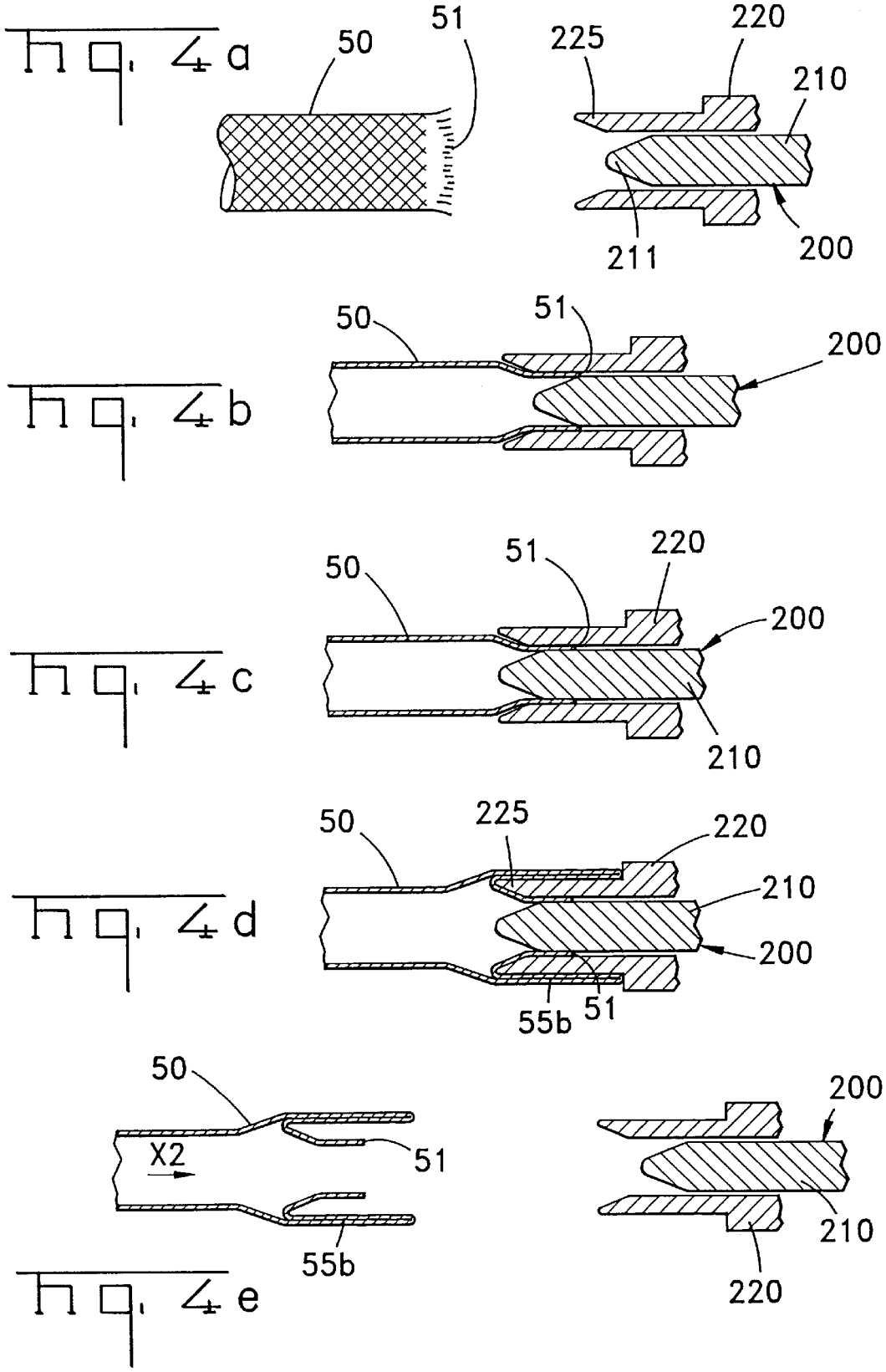
FIGS. 4*a*–4*e* show schematic diagrams illustrating an alternative process in which the shielding member is folded back by using a tool thereby constituting an alternative embodiment of the present invention.

The tool 200 shown in FIG. 4 also includes an inner member 210 and an outer member 220, which are capable of moving relative to each other, and the inner member 210 has a conical front end 211 and the outer member 220 includes an annular protruding section 225. First, the tool 200 is positioned so that it faces the cut end 51 of the shielding member 50 (see FIG. 4*a*). Next, the tool 200 is moved to a position that accommodates the cut end 51 as shown in FIG. 4*b*. Next, the inner member 210 is moved in relative terms in a direction which causes the inner member 210 to move slightly closer to the shielding member 50, and the section of the shielding member 50 in the vicinity of the cut end 51 is frictionally accommodated between the inner member 210 and outer member 220 (see FIG. 4*c*). Next, the tool 200 is pushed within the shielding member 50; in this case, the shielding member 50 is bent so that it turns inward along an outside surface of the annular protruding member 225; as a result, a folded-back section 55*b* is formed (see FIG. 4*d*). Afterward, the inner member 210 is withdrawn in relative terms so that the vicinity of the cut end 51 is released, and the tool 200 as a whole is removed from the shielding member 50 (see FIG. 4*e*). As a result, the folded-back structure is completed as shown in FIG. 4*e* as a double-layer section with a free end of the folded-back section 55*b* extending toward an end of the shielding member 50.

The difference between the example shown in FIG. 3 and the example shown in FIG. 4 lies in the orientation of the cut ends 51 in the folded-back section 55*a*, 55*b*. In the example shown in FIG. 3, the cut end 51 is oriented inward and extends along an inside surface of the shielding member 50; while in the example shown in FIG. 4, the cut end 51 is oriented outward, i.e., extends back toward an end of the shielding member 50. For example, the wires W1, W2 can be smoothly inserted by the appropriate use of these two types of examples. For instance, if the example shown in FIG. 3 is used, then the wires W1, W2 can easily be passed through in the X1 direction (see FIG. 3*e*); accordingly, this example is suitable for use in portion A of FIG. 1*b*. If the example shown in FIG. 4 is used, then the wires W1, W2 can easily be passed through in the X2 direction (see FIG. 4*e*); accordingly, this example is suitable for use in portion B of FIG. 1*b*.

After the second process is performed using the example shown in FIG. 3 or FIG. 4 so that a folded-back structure is realized, a first clamping process which constitutes the third process is performed. In this first clamping process, the shielding member 50 is fastened to the fastening section 21 of the socket 20 by clamping using the clamping member 31. Next, the cap 25 is inserted from the end of the wires W1, W2, and the cap 25 is superimposed on the folded-back structure of the shielding member 50. Then, it is firmly fastened to the cap 25 by means of the clamping member 35 in a second clamping process which constitutes the fourth process. The cap 25 is constructed so that the wires W1, W2 are caused to extend in a different direction from each other. In the subsequent crimping process of the terminals T1, T2, the terminals T1, T2 are electrically connected to the wires W1, W2 oriented in different directions; as a result, the cable connector assembly 10 is completed.

A shielded-cable terminating structure and shielded-cable termination method constituting preferred embodiments of the present invention have been described above. However, they are merely examples, and do not limit the present invention. Various modifications and alterations may be made by a person skilled in the art.

The shielded cable of the present invention has folded-back sections of prescribed dimensions in which the shielding member is folded inward at the end portions so that a double layer is formed; furthermore, the shielded cable of the present invention is constructed so that the folded-back sections are fastened to supporting members by clamping members. Accordingly, unraveling of the folded-back sections of the shielding member is reduced, and the folded-back sections can be held with high strength; furthermore, an optimum shielding effect is ensured in the vicinity of the folded-back sections.

Furthermore, the shielded-cable termination method of the present invention includes a process in which the end portions of a braided-shielding member for a sealed cable are folded back, and a process in which the folded-back end portions of the shielding member are positioned on supporting members and fastened thereon by clamping from an outside by means of clamping members. Accordingly, handling of the end portions is easy, and the end portions can be securely installed on the supporting members and fastened thereon with high strength and an optimum shielding effect.

What is claimed is:

1. A shielded cable structure, comprising an electrical connector having a fastening section;

a braided shielding member having at one end a folded-back section extending along an inside surface of the shielding member defining a double-layer section positioned onto the fastening section; and a clamping member engaging the double-layer section and clamping the double-layer section onto the fastening section.

2. A shielded cable structure as claimed in claim 1, wherein a free end of the folded-back section extends along the inside surface of the shielding member.

3. A shielded cable structure as claimed in claim 1, wherein a free end of the folded-back section extends back toward a front end of the double-layer section.

* * * * *